US010881265B2

(12) United States Patent
Metzel et al.

(10) Patent No.: US 10,881,265 B2
(45) Date of Patent: Jan. 5, 2021

(54) TWIST MOP WITH BIASED CUP

(71) Applicant: Freudenberg Household Products LP, Aurora, IL (US)

(72) Inventors: Doug Metzel, Berwyn, IL (US); Conrad Alfaro, Bolingbrook, IL (US)

(73) Assignee: Carl Freudenberg KG, Weinheim (DE)

( * ) Notice: Subject to any disclaimer, the term of this patent is extended or adjusted under 35 U.S.C. 154(b) by 548 days.

(21) Appl. No.: 15/790,588

(22) Filed: Oct. 23, 2017

(65) Prior Publication Data

US 2018/0042442 A1 Feb. 15, 2018

Related U.S. Application Data

(63) Continuation-in-part of application No. 14/597,975, filed on Jan. 15, 2015, now Pat. No. 10,555,658.

(51) Int. Cl.
*A47L 13/24* (2006.01)
*A47L 13/142* (2006.01)
(Continued)

(52) U.S. Cl.
CPC ..... *A47L 13/24* (2013.01); *A47L 13/142* (2013.01); *A47L 13/20* (2013.01); *A47L 13/255* (2013.01)

(58) Field of Classification Search
CPC ..... A47L 13/20; A47L 13/24; A47L 13/142; A47L 13/14; A47L 13/42; B25G 3/00; B25G 3/20; B25G 3/18; B25G 3/12; B25G 3/30; B25G 3/10; B25G 3/04; Y10T 16/469; Y10T 16/473; Y10T 403/68; Y10T 403/7005; B67B 7/14; B67B 7/18
(Continued)

(56) References Cited

U.S. PATENT DOCUMENTS 2,205,535 A * 6/1940 Muckenhirn ..... A47L 13/24 15/145
6,212,728 B1 4/2001 Facca et al.
(Continued)

FOREIGN PATENT DOCUMENTS

CA 2917657 A1 * 7/2016 ..... A47L 13/142

OTHER PUBLICATIONS

Smalley, "Replace Belleville stacks with Wave Springs", Sep. 28, 2017, Machine Design (Year: 2017).*

*Primary Examiner* — Orlando E Aviles
*Assistant Examiner* — Khawaja H Samiullah
(74) *Attorney, Agent, or Firm* — Leydig, Voit & Mayer, Ltd.

(57) ABSTRACT

A mop includes a mop handle with a grip end and a mopping end. A locking cup is disposed on the mopping end. The locking cup includes a cup portion with interior threads and a locking tooth. A mop head is disposed at the mopping end. The mop head connects to a locking cap. The locking cap includes a locking tab configured to engage with the interior threads of the locking cup to allow for selective removal of the mop head from the mop handle and to engage and be retained by the locking tooth when the locking cap is threaded into the locking cup. A biasing element is disposed in the cup portion and contacts the locking cap and generate a bias between the locking cap and the locking cup and urge the locking tab against the locking tooth when the locking cap is threaded into the cup portion.

12 Claims, 12 Drawing Sheets

(51) Int. Cl.
*A47L 13/20* (2006.01)
*A47L 13/255* (2006.01)

(58) Field of Classification Search
USPC ..... 15/120.1, 120.2, 116.1, 119.1, 145, 228, 15/229.1, 229.2, 147.1, 147.2; 403/97, 403/109.1, 109.4, 109.5, 109.8, 184, 299, 403/303, 305, 314, 342, 343; 81/3.07–3.49
See application file for complete search history.

(56) References Cited

U.S. PATENT DOCUMENTS

| | | | | |
|---|---|---|---|---|
| 6,427,280 | B1 | 8/2002 | Specht | |
| 6,625,838 | B2 | 9/2003 | Laux et al. | |
| 6,732,396 | B2 | 5/2004 | Laux et al. | |
| 7,260,865 | B2 * | 8/2007 | Lesley | A47L 13/142 15/120.1 |
| 2002/0083804 | A1 * | 7/2002 | DiStasio | C07C 213/10 81/437 |
| 2014/0138280 | A1 * | 5/2014 | Meinzer | B25F 1/02 206/577 |

* cited by examiner

TWIST MOP WITH BIASED CUP

CROSS-REFERENCE TO RELATED APPLICATIONS

This patent application is a continuation-in-part application of co-pending U.S. patent application Ser. No. 14/597,975, filed Jan. 15, 2015, which is incorporated by reference in its entirety.

TECHNICAL FIELD

This patent disclosure relates generally to floor cleaning tools and, more particularly, to a mop.

BACKGROUND

Use of floor cleaning tools, such as mops, brooms, brushes, etc., frequently results in portions of those tools becoming saturated with fluids or soiled with the materials absorbed from the cleaned surface. During use, it can be desirable to wring out or otherwise squeeze the saturated fluids from brushes or mop heads attached to the cleaning tools to continue a cleaning application. At certain times, it may be desirable to remove portions of a cleaning tool, such as a mop head, for cleaning or replacement. Removal and reattachment of the mop head should be a simple procedure in order to encourage frequent cleaning or replacement. An improved cleaning tool is needed that allows for easy removal of fluids from portions of the floor cleaning tool and easy removal of portions of the cleaning tool for cleaning or replacement, while the floor cleaning tool is securely held to the cleaning tool during use.

SUMMARY

The disclosure describes, in one aspect, a mop comprising a mop handle with a grip end and a mopping end. The mop includes a plurality of spline ribs disposed on the mop handle between the grip end and the mopping end. The spline ribs substantially surround a surface of the mop handle and are aligned substantially with the mop handle. The mop includes a ratchet sleeve concentrically surrounding the mop handle so as to be rotatable in first and second rotational directions with respect to the mob handle. The ratchet sleeve includes a flexible collar with an inward-facing integral pawl disposed on an interior portion of the flexible collar facing the mop handle. The mop includes a mop head disposed at the mopping end of the mop handle. The mop head has a first end connected to the mopping end of the mop handle and a second end connected to the ratchet sleeve. The flexible collar of the ratchet sleeve is flexible between a locked position in which the pawl engages with the spline ribs so as to substantially prevent rotation of the ratchet sleeve with respect to the mop handle in the first rotational direction, and an unlocked position, in which the pawl disengages the spline ribs so as to allow rotation of the ratchet sleeve with respect to the mop handle in both the first and second rotational directions.

In another aspect, the disclosure describes a mop comprising a mop handle with a grip end and a mopping end. The mop includes a locking cup disposed on the mopping end of the mop handle. The mop also includes a ratchet sleeve concentrically surrounding the mop handle so as to be rotatable and slidable with respect to the mob handle. The mop also includes a mop head having a first end connected to a locking cap and a second end connected to the ratchet sleeve. The locking cap is configured to selectively engage with the locking cup so as to allow for selective removal of the mop head from the mop handle.

In another aspect, the disclosure describes a mop comprising a mop handle with a grip end and a mopping end. The mop includes a locking cup disposed on the mopping end of the mop handle, and a plurality of spline ribs disposed on the mop handle between the grip end and the mopping end. The spline ribs substantially surround a surface of the mop handle and is aligned substantially with the mop handle. The mop includes a ratchet sleeve concentrically surrounding the mop handle so as to be rotatable with respect to the mob handle. The ratchet sleeve includes a flexible collar with an inward-facing integral pawl disposed on an interior portion of the flexible collar facing the mop handle. The mop also includes a mop head having a first end connected to a locking cap and a second end retained around the ratchet sleeve. The locking cap is configured to selectively engage with the locking cup so as to allow for selective removal of the mop head from the mop handle. The flexible collar is biased toward a locked position in which the pawl engages with the spline ribs so as to substantially prevent rotation of the ratchet sleeve in a first rotational direction with respect to the mop handle. The flexible collar is flexible into an unlocked position in which the pawl disengages the spline ribs so as to allow rotation of the ratchet sleeve with respect to the mop handle in the first rotational direction and a second rotational direction.

In yet another aspect, the disclosure contemplates a mop that includes a mop handle with a grip end and a mopping end. A locking cup is disposed on the mopping end. The locking cup includes a cup portion with interior threads and a locking tooth. A mop head is disposed at the mopping end. The mop head connects to a locking cap. The locking cap includes a locking tab configured to engage with the interior threads of the locking cup to allow for selective removal of the mop head from the mop handle and to engage and be retained by the locking tooth when the locking cap is threaded into the locking cup. A biasing element is disposed in the cup portion and contacts the locking cap and generate a bias between the locking cap and the locking cup and urge the locking tab against the locking tooth when the locking cap is threaded into the cup portion.

DETAILED DESCRIPTION

Figure 1:
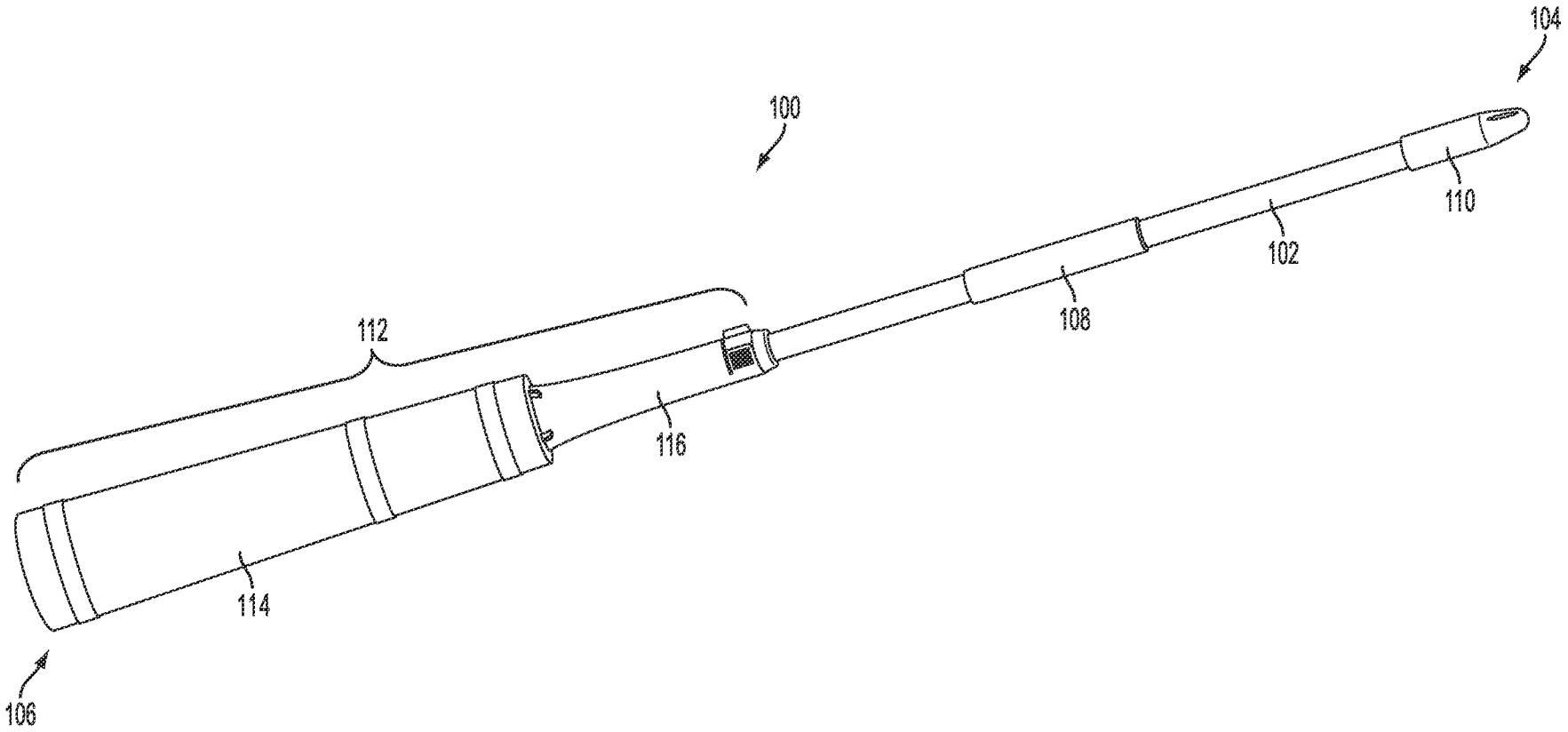
FIG. 1 is a perspective view of a mop in a wringing position in accordance with the disclosure.

This disclosure relates to a mop. Referring to the figures, FIG. 1 shows a mop 100 in accordance with the disclosure. The mop 100 includes a mop handle 102 that has a grip end 104 and a mopping end 106 disposed at opposite ends of the mop handle 102. The mop 100 includes a pad 108 between the grip end 104 and the mopping end 106, and a hanging grip 110 disposed on the grip end. The mop 100 also includes a twist mop assembly 112 disposed on the mopping end 106. The twist mop assembly 112 includes a mop head 114 and a ratchet sleeve 116 connected to one another. The ratchet sleeve 116 concentrically surrounds the mop handle 102 and is rotatable with respect to the mop handle. The mop head 114 includes a plurality of strands 122. It should be understood that the depiction of the mop head 114 in FIGS. 1, 3, 4, 5, 9, and 10 as a solid feature as opposed to a plurality of strands is for illustrative purposes only. In some embodiments, as will be described in further detail below, the ratchet sleeve 116 can be rotated about the mop handle 102 to wring out the mop head 114 during a floor cleaning application.

Figure 2:
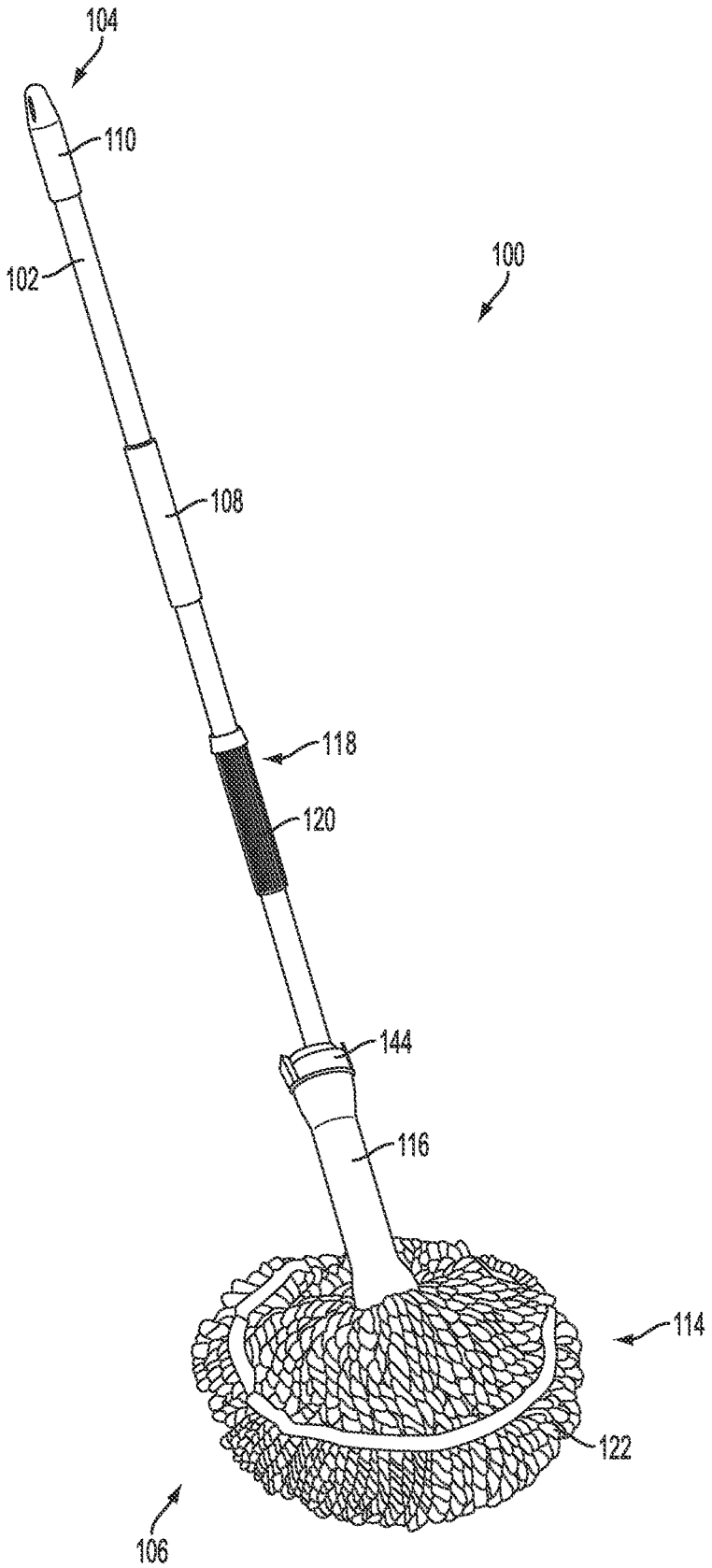
FIG. 2 is a perspective view of the mop of FIG. 1 in a mopping position.

FIG. 1 shows the mop 100 in a wringing position, and FIG. 2 shows the mop 100 in a mopping position in which the ratchet sleeve 116 is disposed near the mopping end 106 and a spline sleeve 118 is shown disposed on the mop handle 102. The spline sleeve 118 includes a plurality of spline ribs 120 that substantially surround a surface of the mop handle 102 and are substantially aligned with mop handle. The spline ribs 120 include a series of ridges and slots between adjacent ridges substantially parallel with one another and substantially aligned with the mop handle 102. Although the spline sleeve 118 in FIG. 2 is shown as a detachable sleeve disposed on the mop handle 102, it is contemplated that the spline ribs can be integral with the mop handle in some embodiments. In the wringing position shown in FIG. 1, the ratchet sleeve 116 is disposed substantially overlapping the spline ribs 120 of the spline sleeve 118, pulling the mop head 114 tight around the mop handle 102. In the mopping position shown in FIG. 2, the ratchet sleeve 116 is disposed between the spline sleeve 118 and the mopping end 106 of the mop handle 102. In the mopping position, the strands 122 of the mop head 114 are substantially relaxed and in position for mopping and other floor cleaning applications.

Figure 3:
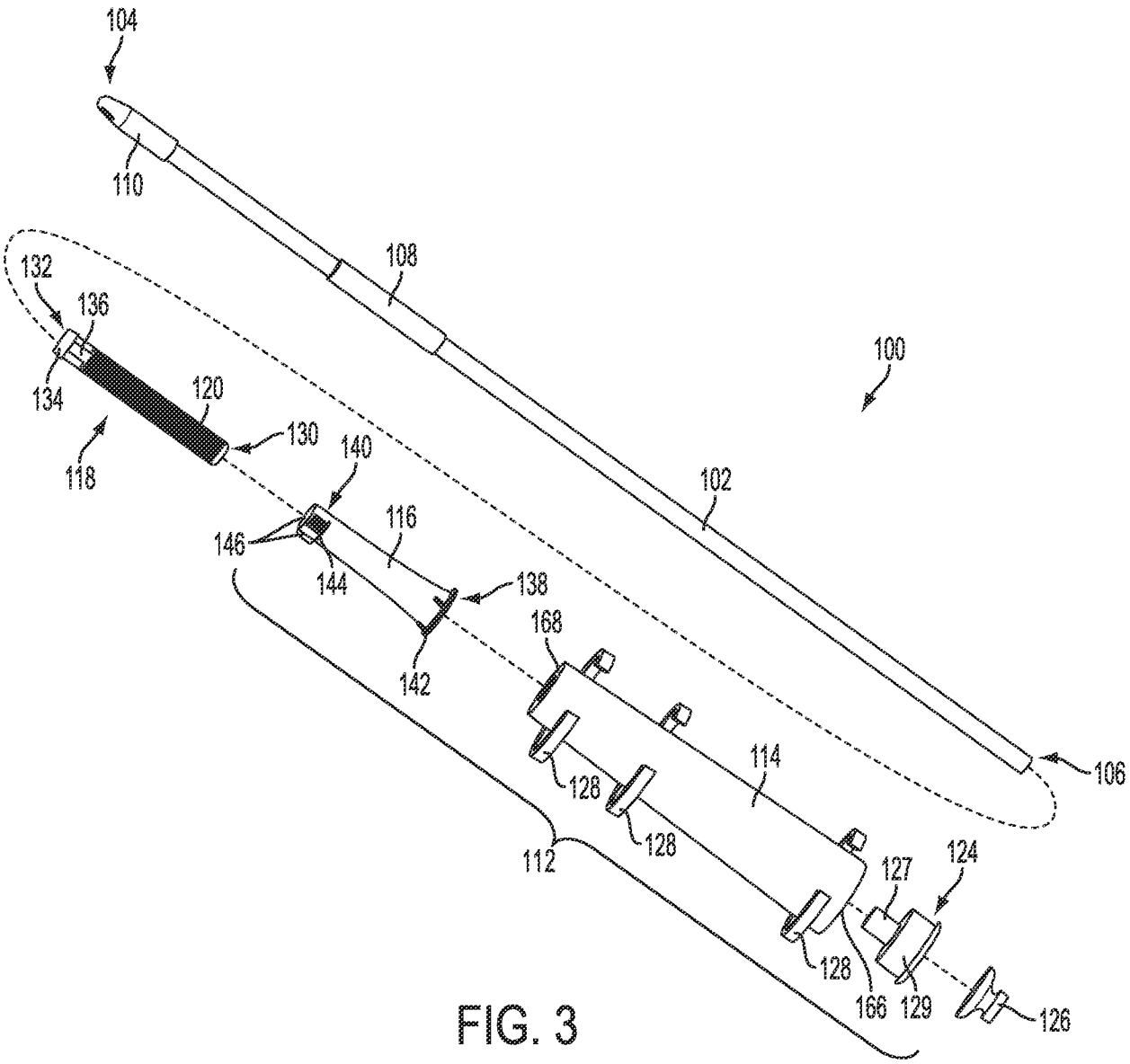
FIG. 3 is an exploded view of the mop of FIG. 1.
Figure 5:
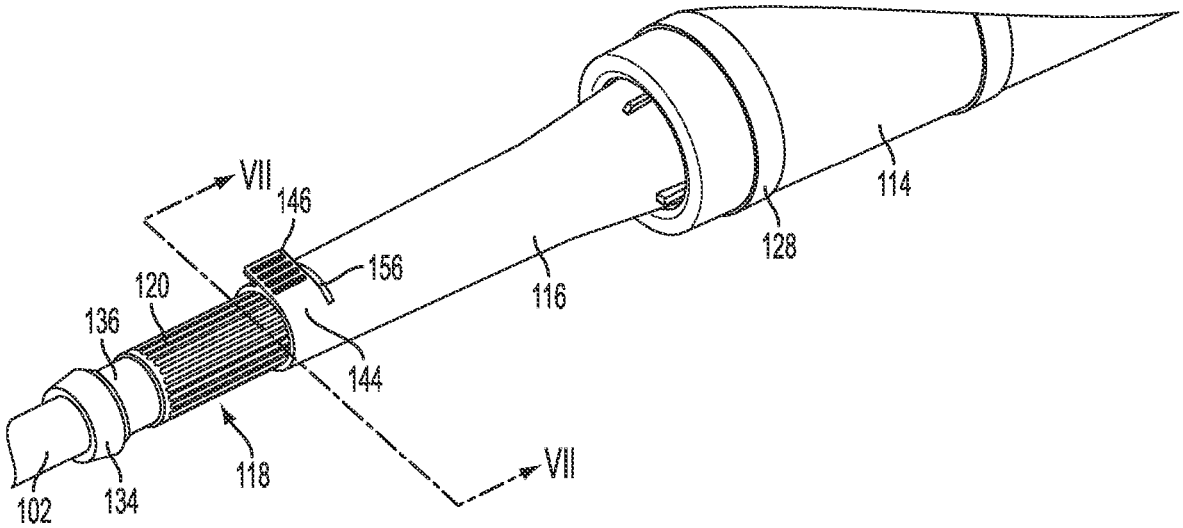
FIG. 5 is a partial perspective view of the mop of FIG. 1.

FIG. 3 shows an exploded view of the mop 100. In addition to the ratchet sleeve 116 and the mop head 114, the twist mop assembly 112 further includes a locking cup 124, a locking cap 126, and a plurality of mop head bands 128. In the embodiment illustrated in FIG. 3, the spline sleeve 118 has a hollow tube shape and fits over the mop handle 102. The spline sleeve 118 can be adhered, press-fit, or otherwise fastened into place between the grip end 104 and the mopping end 106. Spline ribs 120 cover a substantial portion of the spline sleeve 118 between a bottom end 130 and a top end 132. The top end 132 terminates in a stop collar 134 that has a larger diameter than the remainder of the spline sleeve 118, and a larger diameter than at least a portion of the ratchet sleeve 116. Thus, although the ratchet sleeve 116 can slide over the bottom portion 130 of the spline sleeve 118 to substantially overlap the spline ribs 120, the stop collar 134 prevents the ratchet sleeve 116 from sliding fully over the spline sleeve 118 toward the grip end 104 of the mop handle 102. As best seen in FIG. 5, the spline sleeve 118 also has a smooth portion 136 near the top end 132 between the stop collar 134 and the spline ribs 120. Although the smooth portion 136 of the spline sleeve 118 can have ribs in certain embodiments, the smooth portion has fewer ribs than the amount of ribs between the smooth portion and the bottom end 130 of the spline sleeve.

Referring again to FIG. 3, the ratchet sleeve 116, which also has a substantially tubular shape, fits concentrically around the mop handle 102 and can slide up and down between the spline sleeve 118 and the mopping end 106 of the mop handle. The ratchet sleeve 116 is also free to rotate concentrically around the mop handle 102 while between the spline sleeve 118 and the mopping end, but can be selectively restricted from rotating about the spline sleeve under certain conditions.

More specifically, in the illustrated embodiment, the ratchet sleeve 116 includes a retaining end 138 and a pawl end 140. The ratchet sleeve 116 tapers outwardly from the pawl end 140 to the retaining end 138, terminating at the retaining end 138 with a retaining collar 142 protruding radially outward from the ratchet sleeve. The diameter of the ratchet sleeve 116 at the pawl end 140 is at least slightly larger than the diameter of the spline sleeve 118 so as to allow for the ratchet sleeve to slide over the spline sleeve at least until the stop collar 134. The pawl end 140 includes a flexible collar 144 with tabs 146 that can be squeezed toward one another in order to selectively flex the flexible collar between a substantially circular shape and a substantially ovular shape. Although the figures herein show two tabs 146 on the flexible collar 144, embodiments with more or fewer tabs are also contemplated. Additionally, although the illustrated embodiment shows a flexible collar 144 that is at the pawl end 140 of the ratchet sleeve 116, other embodiments in which the flexible collar is disposed at other sections of the ratchet sleeve, or even embodiments in which the entire ratchet sleeve is a flexible collar, are also contemplated herein.

Figure 6:
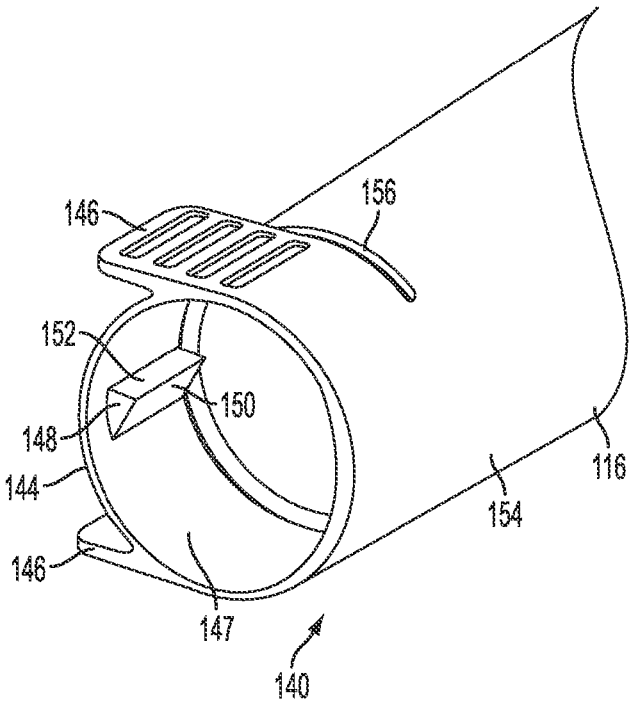
FIG. 6 is a perspective view of an integrated pawl of the mop of FIG. 1 in accordance with the disclosure.

As best shown in FIG. 6, the flexible collar 144 includes an inward-facing integral pawl 148 disposed on an interior portion 147 of the flexible collar facing the mop handle 102. The pawl 148 is substantially wedge-shaped, having an angled portion 150 and a stopping portion 152. In the embodiment illustrated in FIG. 6, the stopping portion 152 of the pawl 148 projects substantially perpendicularly from the interior portion 147 of the flexible collar 144. The flexible collar 144 itself is partially integral with the remainder of the ratchet sleeve 116 and connects to the ratchet sleeve via a bridge 154. At least a portion of the flexible collar 144, however, is separated from the ratchet sleeve 116 by a collar slit 156 formed between the ratchet sleeve and the flexible collar. In the illustrated embodiment, the pawl 148 is disposed along the interior surface 147 of the flexible collar 144 substantially opposite the bridge 154 and substantially between the two tabs 146. Thus, when a user applies force to the tabs 146, for example, squeezing the tabs toward one another, the flexible collar 144 can flex from a substantially circular shape, as shown in FIG. 6, to an ovular shape that moves the pawl 148 further from the bridge 154.

In some embodiments, the flexible collar 144 is biased into a substantially circular shape such that it will spring back into a substantially circular shape when the force applied to the tabs 146 is released.

Figure 7:
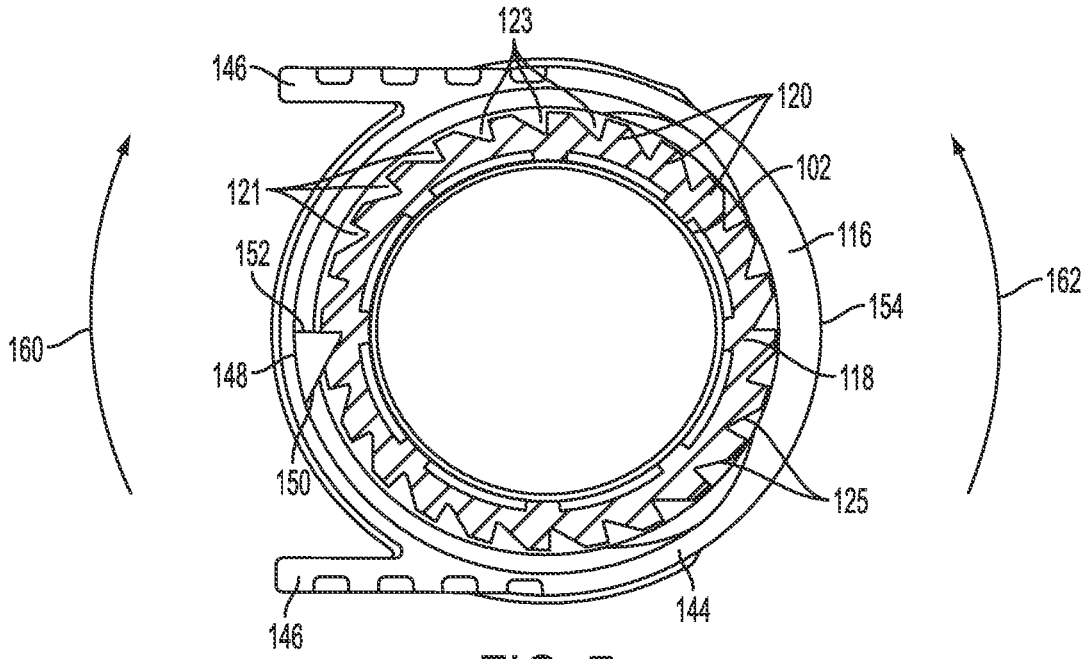
FIG. 7 is a sectional view of the mop of FIG. 1, as indicated in FIG. 5, showing the integrated pawl in a locked position.

As shown in FIG. 5, the flexible collar 144 of the ratchet sleeve 116 can slide over the spline sleeve 118. The diameter of the flexible collar 144 is such that the flexible collar can slide over the spline ribs 120, but that the pawl 148 extends inward toward the spline sleeve 118 in an engaging relationship with the spline ribs. The selectively engaging relationship between the pawl 148 and the spline ribs 120 can be seen in FIGS. 7 and 8. Specifically, FIG. 7 shows a cross section of the mop 100 with the ratchet sleeve 116 disposed to concentrically surround the spline sleeve 118 mounted on the mop handle 102. In FIG. 7, the flexible collar 144 is in a locked position in which the pawl engages with the spline ribs 120 so as to substantially prevent rotation of the ratchet sleeve 116 with respect to the mop handle 102 in a first rotational direction 160. In the locked position, the pawl 148 is disposed in one of a plurality of valleys 121 formed between adjacent spline ribs 120 such that the stopping portion 152 of the pawl abuts a wall portion 123 of a spline rib. Although the illustrated embodiment includes only a single pawl engaged with a single spline rib at a time, other embodiments that include multiple pawls engaged with multiple spline ribs are also contemplated herein.

When in the locked position, such as in the embodiment shown in FIG. 7, the ratchet sleeve 116 is prevented from rotating with respect to the mop handle 102 in a first rotational direction 160, but can be rotated with respect to the mop handle in a second rotational direction 162. As shown, the angled portion 150 of the pawl 148 can slide against a sloped portion 125 of the spline ribs 120, allowing rotation of the ratchet sleeve 116 in the second rotational direction 162. Thus, in the locked position, a ratcheting effect is possible in which the ratchet sleeve 116 is rotatable about the mop handle 102 in the second rotational direction 162, such as to tighten the twist mop assembly 112, and the ratchet sleeve is simultaneously prevented from rotating about the mop handle 102 in the second rotational direction 160. It is contemplated that, in some embodiments, the pawl and spline ribs can instead be configured to allow the ratchet sleeve to rotate in the first rotational direction with respect to the mop handle and to prevent the ratchet sleeve from rotating in the second rotational direction when in the locked position.

Figure 8:
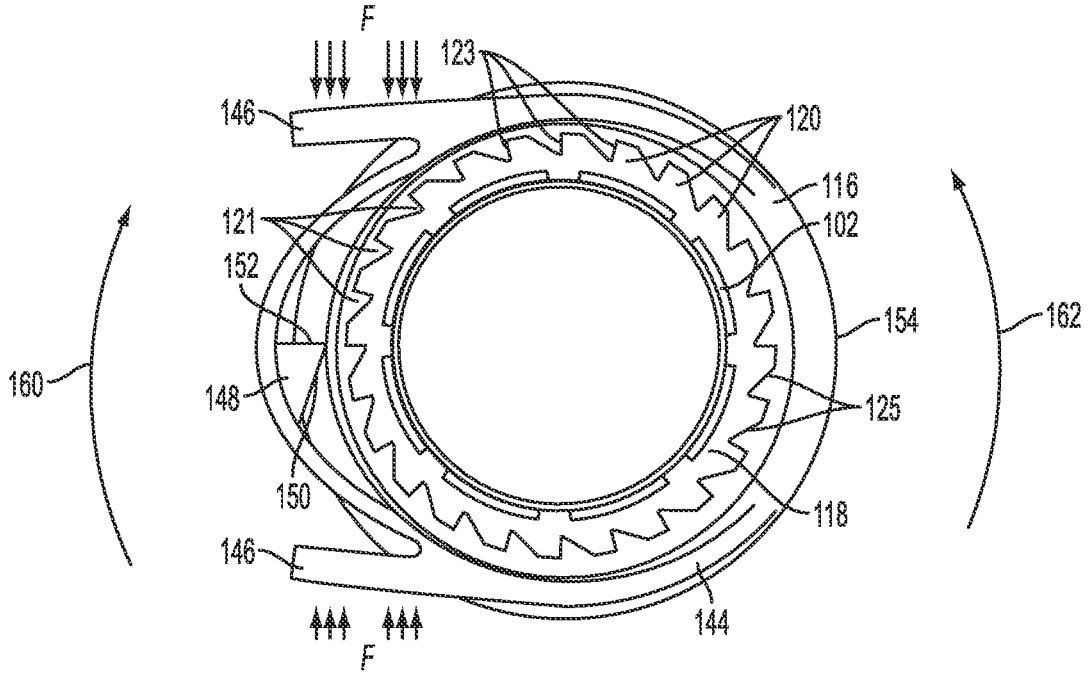
FIG. 8 is a sectional view of the mop of FIG. 1, as indicated in FIG. 5, showing the integrated pawl in an unlocked position.

FIG. 8 shows the flexible collar 144 in an unlocked position in which the pawl 148 disengages the spline ribs 120 so as to allow rotation of the ratchet sleeve 116 with respect to the mop handle 102 in both the first and second rotational directions 160, 162. The flexible collar 144 is flexed from the locked position to the unlocked position when a squeezing force, F, is applied to the tabs 146. The squeezing force F causes the flexible collar 144 in the vicinity of the pawl 148 to bow outward into a substantially ovular shape and pull the pawl out from the valleys 121 between spline ribs 120. In the unlocked position, the pawl 148 is no longer preventing rotation of the ratchet sleeve 116 with respect to the mop handle 102 in the first direction 160 because the stopping portion 152 of the pawl is now longer abutting the wall portion 123 of any spline ribs 120. Once the squeezing force F is released from the tabs 146, the flexible collar 144 is biased back into the locking position.

Figure 4:
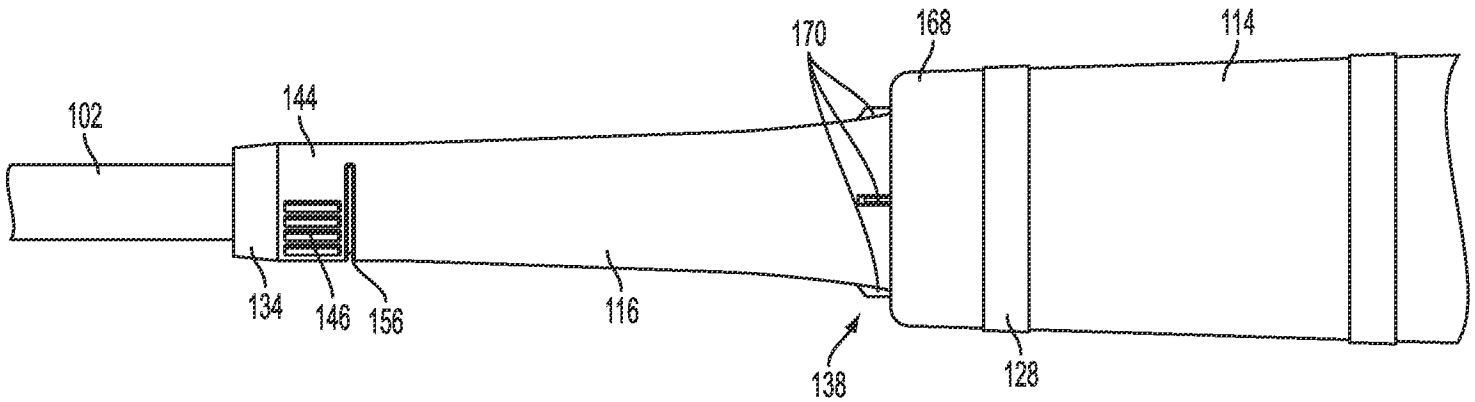
FIG. 4 is a partial front view of the mop of FIG. 1.

Referring again to FIG. 3, the mop head 114 has a first end 166 opposite a second end 168. In some embodiments, the first end 166 of the mop head 114 is connected to the mopping end 106 of the mop handle 102, and the second end 168 is connected to the ratchet sleeve 116. The mop head 114 can include a plurality of mop head bands 128 that concentrically surround the mop head to connect the plurality of strands 122 to one another. Although the illustrated embodiment shows three mop head bands 128, it is contemplated that more or fewer bands can be used in other embodiments. As shown in FIG. 4, the second end 168 of the of the mop head 114 fits over the retaining collar 142 on the ratchet sleeve 116. Wire, zip ties, or any other suitable retaining mechanism can retain the second end 168 of the mop head 114. In some embodiments, when the second end 168 of the mop head 114 is disposed over and around the retaining end 138 of the ratchet sleeve 116, a plurality of tightening ribs 170 can help secure the mop head in place against the retaining collar 142. The retaining collar 142 prevents the mop head 114 from sliding off of the ratchet sleeve 116 and pulls the second end 168 of the mop head toward the grip end 104 of the mop handle 102 when the ratchet sleeve is pulled toward the grip end. Additionally, the tightening ribs 170 help maintain a tight connection of the second end 168 of the mop head 114 against the ratcheting sleeve 116 so that when the ratcheting sleeve is rotated with respect to the mop handle 102, the second end of the mop head rotates along with the ratchet sleeve.

For example, FIG. 5 shows an embodiment of the mop 100 in a wringing position. In the wringing position, the flexible collar 144 and, thus, the pawl 148, is disposed adjacent the plurality of spline ribs 120 on the spline sleeve 118. When the flexible collar 144 is in the locking position, the ratchet sleeve 116 can be rotated with respect to the mop handle 102 in the second rotational direction. Because the first end 166 of the mop head 114 is connected to the mopping end 106 of the mop handle and, thus, is substantially stationary with respect to the mop handle, rotating the ratchet sleeve 116 will result in the mop head 114 twisting around the mop handle 102. As the mop head 114 is twisted, the plurality of strands 122 in the mop head will constrict against one another in a wringing action that will tend to wring water or other fluids out of the mop head. The pawl 148 then prevents the mop head 114 from untwisting itself an adequate squeezing force F is applied to the tabs 146, disengaging the pawl from the spline ribs 120 and moving the flexible collar 144 into the unlocked position. In this way, during a cleaning or mopping application, as the mop head 114 becomes soiled or otherwise saturated with fluid, the user can rotate the ratchet sleeve 116 with respect to the mop handle to wring the fluid out of the mop head strands 122.

Figure 9:
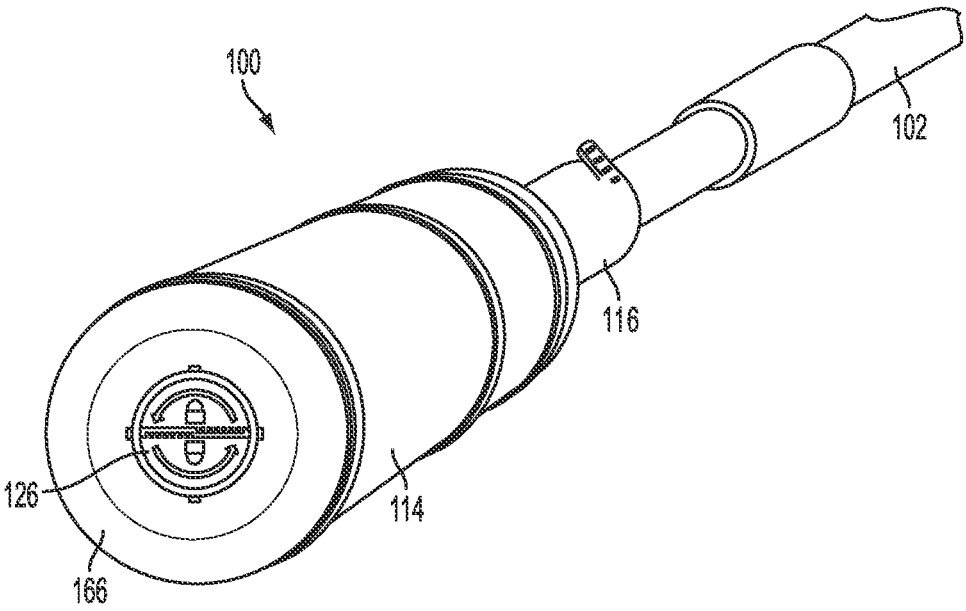
FIG. 9 is a partial perspective view of the mop of FIG. 1 showing a locking cap in accordance with the disclosure.

When the mop 100 is not in the wringing position, the mop can be moved into a mopping position, as shown in FIG. 2, in which the ratchet sleeve 116 slides down the mop handle 102 such that the flexible collar 144 and the pawl 148 are disposed between the spline sleeve 118 and the mopping end 106 of the mop handle. In the mopping position, the strands 122 of the mop head 114 are relaxed and can more effectively engage a surface to be cleaned. Referring again to FIG. 3, in some embodiments, the mop head 114 is secured to the mop handle 102 with an interlocking locking cup 124 and locking cap 126 combination. The locking cup and cap 124, 126 combination allows the mop head 114 to be easily secured and removed from the mop handle 102, as it may be desired to remove the mop head, for example, to clean or replace the mop head after extended use. FIG. 9 shows an embodiment of the mop 100 with the locking cap 126 securing the first end 166 of the mop head 114 to the mop handle 102.

Figure 10:
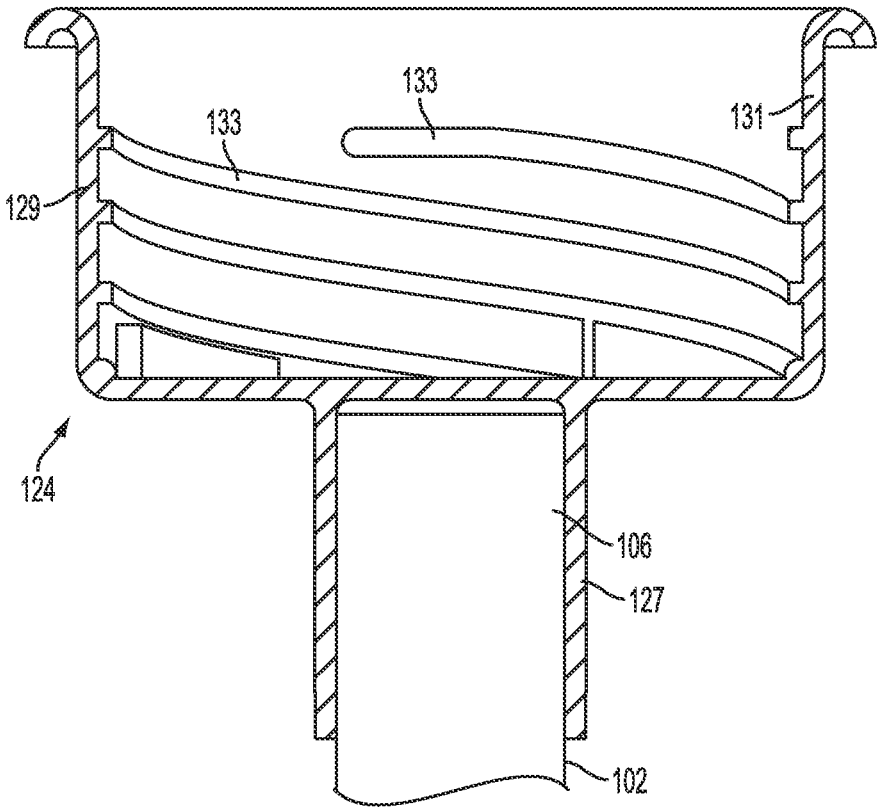
FIG. 10 is a sectional view of a locking cup of the mop of FIG. 1.
Figure 12:
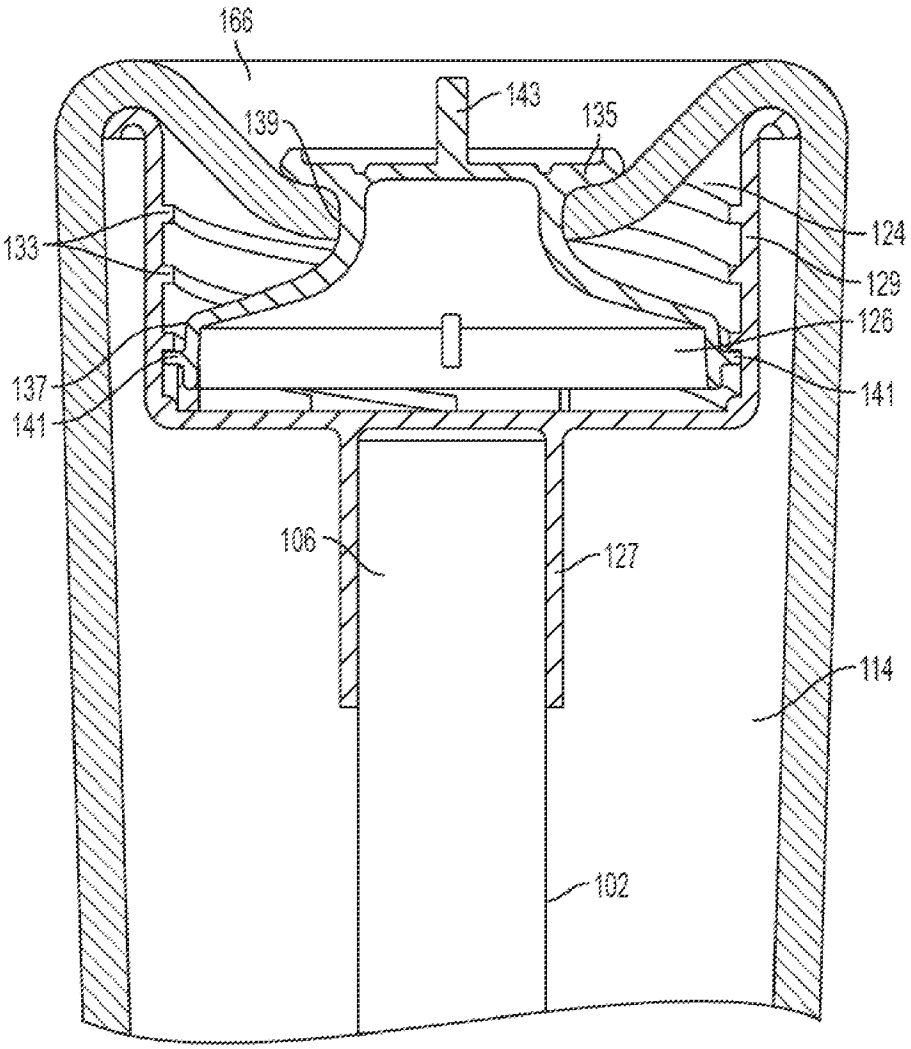
FIG. 12 is a partial sectional view of the mop of FIG. 1 showing the interaction between a locking cap, locking cup, and mop head in accordance with the disclosure.
Figure 11:
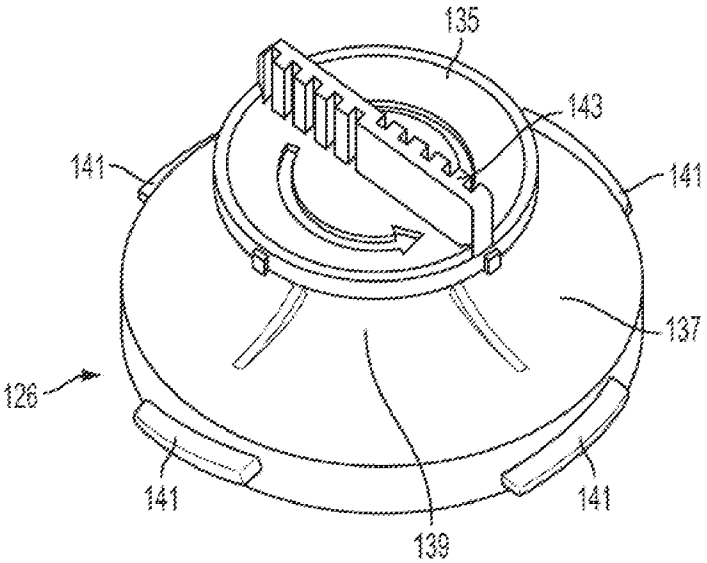
FIG. 11 is a perspective view of the locking cap of FIG. 9.

Referring now to FIGS. 10-12, the locking cup 124 has a sleeve portion 127 and a cup portion 129 opposite one another. The sleeve portion 127 is substantially tubular and can be press fit or otherwise adhered over the mopping end 106 of the mop handle 102. In some embodiments, the sleeve portion 129 can be disposed within the mop handle 102 and, in yet other embodiments, the locking cup 124 can be integral with the mop handle at the mopping end 106. Referring now particularly to FIG. 10, the cup portion 129 of the locking cup 124 has a substantially cylindrical cup interior wall 131. The cup interior wall 131 has a plurality of interior threads 133. The locking cap 126, shown in FIG. 11, is configured to selectively engage with the locking cup 124 so as to allow for selective removal of the mop head 114 from the mop handle 102. The locking cap 126 has a tab portion 135 and a locking portion 137 separated by a neck portion 139. The neck portion 139 has a substantially smaller diameter than both the tab portion 135 and the locking portion 137, resulting in a substantially hour-glass shape. The locking portion 137 of the locking cap has at least one locking tab 141 projecting radially away from the edges of the locking cap. Although the illustrated embodiment shows four locking tabs, more or fewer locking tabs are contemplated in other embodiments. The locking portion 137 of the locking cap 126 can be selectively twisted into the locking cup 124 so that the locking tabs 141 engage with the interior threads 133 of the locking cup, securing the locking cap and the locking cup to one another. The tab portion 135 of the locking cap 126 has a twisting tab 143 projecting away from the locking portion 137 that can be used to twist the locking cap into place within the locking cup 124. Although threads and locking tabs are used to secure the locking cap to the locking cup in the illustrated embodiments, other suitable attachment mechanisms are contemplated herein.

Referring now to FIG. 12, the first end 166 of the mop head 114 is secured to the locking cap 124 around the neck portion 139 of the locking cap using wire, zip ties, or any other suitable fastening mechanism. Thus, when the locking cap 126 is secured into the locking cup 124, the mop head 114 is effectively secured to the mop handle 102 via the connection between the locking cap, the locking cup, and the mopping end 106 of the mop handle 102. In some embodiments, the strands 122 on the first end 166 of the mop head 114 adjacent the tab portion 135 of the locking cap 126 are squeezed between the tab portion and the interior wall 131 of the locking cup 124 to help secure the mop head in place at the mopping end 106 of the mop handle 102.

In some embodiments, the action of wringing out the mop head 114 can result in further tightening the locking cap 126 into the locking cup 124. For example, in some embodiments, the interior threads 133 of the locking cup 124 are oriented such that the locking cap 126 is rotated in the second rotational direction 162 (as indicated in FIG. 7) to tighten the locking cap into the locking cup. As shown in FIG. 12, when the first end 166 of the mop head 114 is secured to the locking cap 126, the first ends of the strands 122 of the mop head are squeezed between the tab portion 135 of the locking cap and the interior wall 131 of the locking cup 124 when the locking cap is secured within the locking cup. Because the second end 168 of the mop head 114 is secured to the ratchet sleeve, the first end 166 of the mop head feels a rotational force in the second rotational direction when a user rotates the ratchet sleeve in the second rotational direction 162 in the act of wringing out the mop head. The friction present between the first end 166 of the mop head 114 and the locking cap 126 as the first end of the mop head is squeezed against the locking cap can cause some of that rotational force to be transferred to the locking cap. Thus, the rotation of the ratchet sleeve 116 in the second rotational direction 162 to wring out the mop head can result in at least some rotation of the locking cap 126 in the second rotational direction, further tightening the locking cap into the locking cup 124 and further securing the first end 166 of the mop head 114 to the mopping end 106 of the mop handle. In other words, when a user wrings out the mop head 114 during use, the mop head will stay secured to the mop handle; however, the user can still easily remove the mop head when desired by simply rotating the locking cap 126 in the first rotational direction 160 to disengage the locking cap from the locking cup 124.

Figure 13:
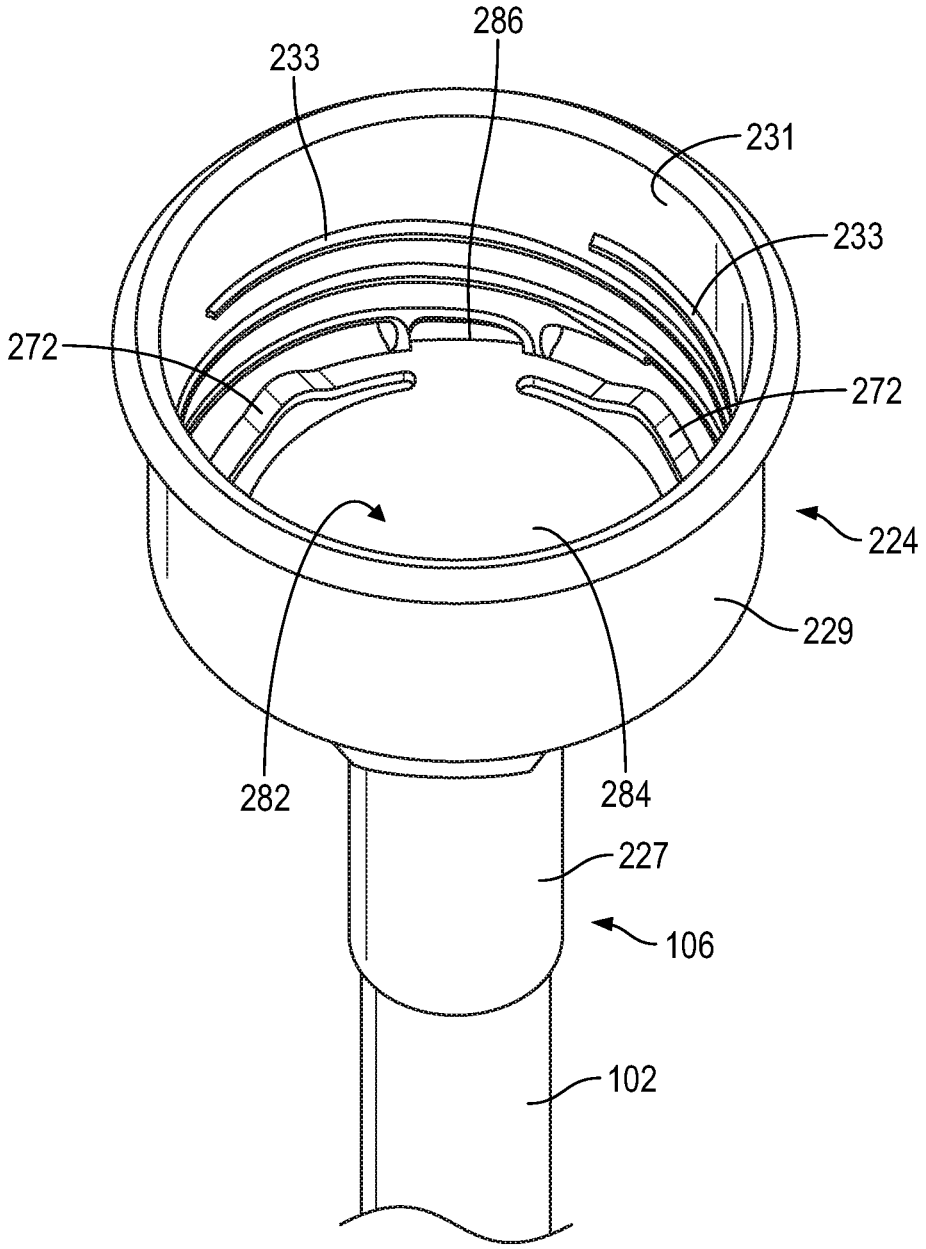
FIG. 13 is a perspective view of another embodiment of a locking cup.
Figure 14:
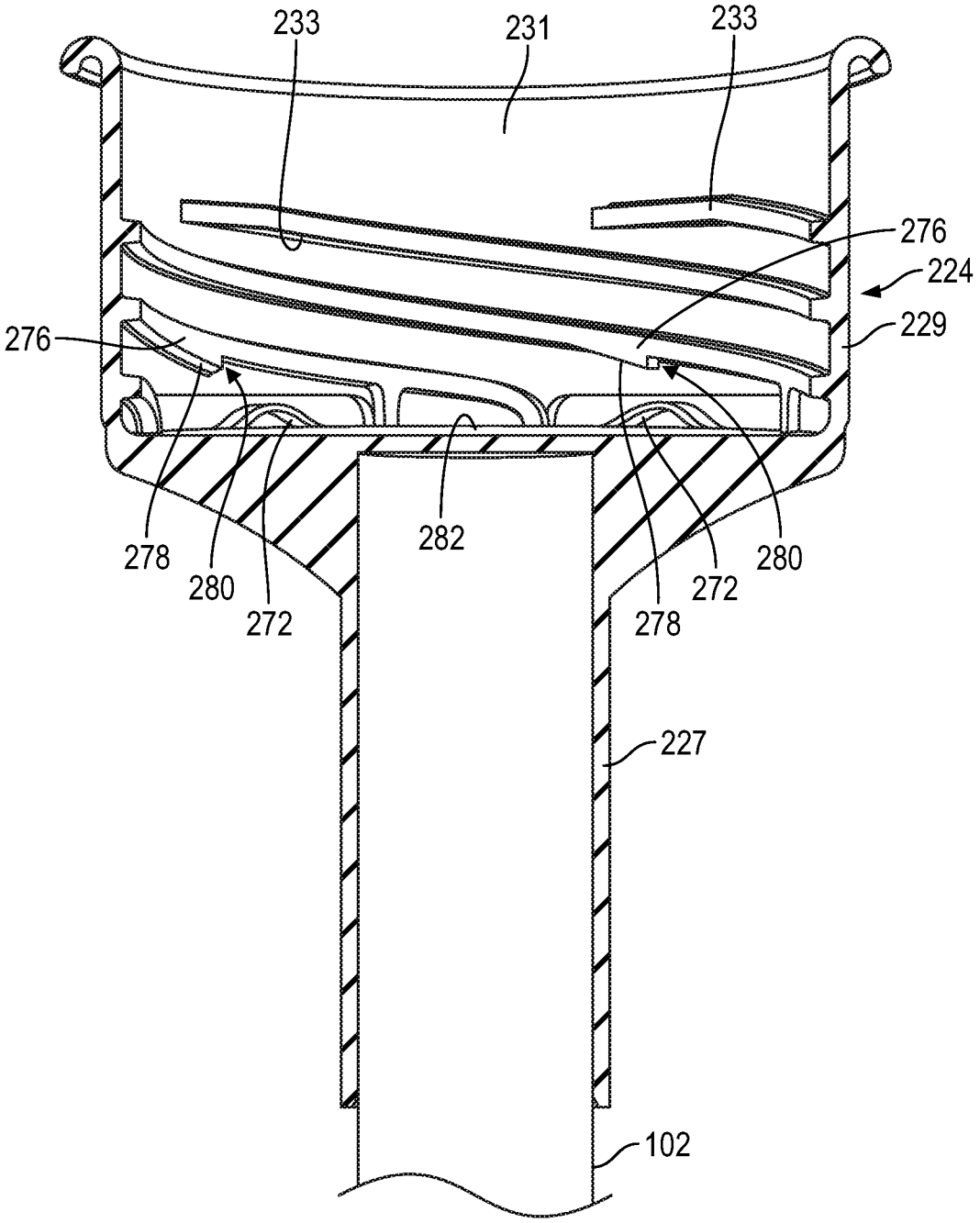
FIG. 14 is a sectional view of the locking cup of FIG. 13.
Figure 15:
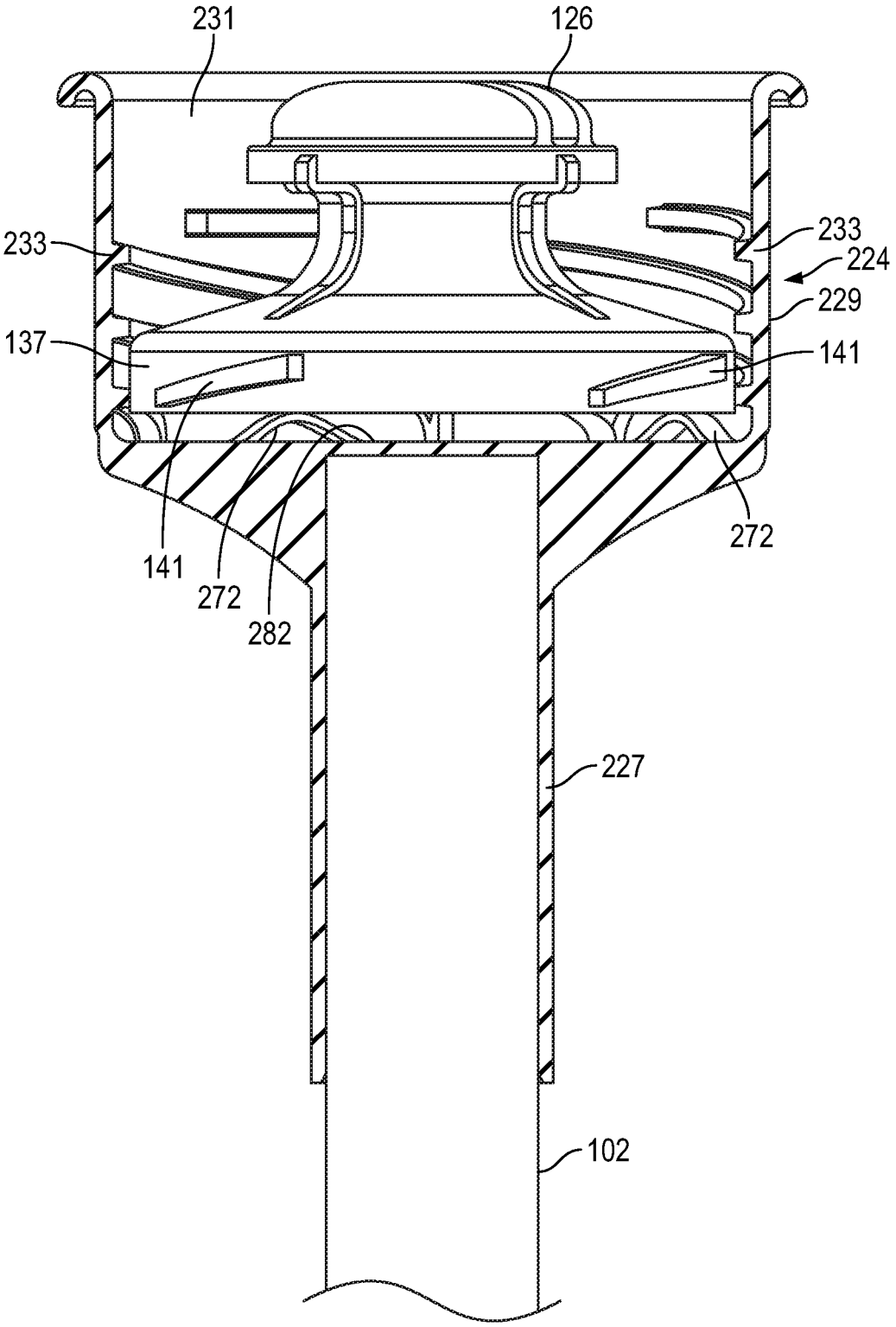
FIG. 15 is a partial sectional view of mop of FIG. 1 showing the interaction between a locking cap and the locking cup of FIGS. 13 and 14 in accordance with the disclosure.

Referring now to FIGS. 13-15, an alternative embodiment of for a locking cup 224 arrangement is shown. The locking cup 224 is generally the same in construction as the above-disclosed embodiments but includes features that aid in retaining the locking cup 224 in its releasable engagement with the mop. The locking cup 224 has a sleeve portion 227 opposite a cup portion 229. The sleeve portion 227 is shaped and sized to press fit or otherwise fit securely to the mopping end 106 of the mop handle 102 (FIG. 3).

Referring now particularly to FIGS. 13 and 14, the cup portion 229 of the locking cup 224 has an interior wall 231. The interior wall 231 may be cylindrical. The cup interior wall 231 includes interior threads 233. The interior threads 233 are configured to selectively engage the locking tabs 141 of the locking cap 126, shown in FIG. 11, to secure the locking cap 126 to the locking cup 224.

The locking portion 137 of the locking cap 126 (FIG. 11) can be selectively twisted into the locking cup 224 so that the locking tabs 141 engage with the interior threads 233, securing the locking cap and the locking cup to one another.

In one embodiment, the interior threads 233 of the locking cup 224 include at least one locking tooth 276 that is sized and shaped to engage a trailing end of a corresponding one of the locking tabs 141 when the locking cap 126 is threaded to the locking cup 224. The locking tooth 276 is shaped and sized to resist or prevent unthreading or disengagement of the locking cap 126 from the locking cup 224 once a locking tab 141 is engaged with a locking tooth 276.

Each locking tooth 276 may include a ramp side 278 and a retaining side 280. The ramp side 278 is formed on or positioned on an underside (according to the orientation as in FIG. 14) of a corresponding thread 233 and guides locking tab 141 over the locking tooth 276 during threading engagement of the locking cap 126 with the locking cup 224. The retaining side 280 of the locking tooth 276 is a relative steeper face of the locking tooth that abuts the retaining side 280 of the locking tooth 276 and prevents the locking tab 141 from reversing in the unthreading direction over the locking tooth and thus prevents the locking cap from backing out of and disengaging from the locking cup 224.

Thus, during threading engagement of the locking cap 126 to the locking cup 224 the locking tab 141 passes over the ramp side 278 of the locking tooth 276. The ramp shape of the ramp side 278 causes the locking tab 141 to deflect resiliently from its initial radially extending position on the locking cap 126. Alternatively, the entire cap 126 steps downwardly, in the direction shown in FIG. 14, to allow the locking tabs 141 to pass over the respective ramp shapes. There may be one locking tooth 276 for each locking tab 141 of the cap 126. When the locking tab 141 clears the ramp side 278, it returns to its initial position and falls into engagement with the retaining side 280, which blocks the locking cap 126 from reversing in direction. Thus, the cap 126 tends to stay in position locked to the locking cup 224.

In an embodiment, the locking cup 224 may include at least one biasing element 272. The biasing element 272 may be disposed inside the interior of the locking cup 224. The biasing element 272 may be part of or formed integral with a bottom wall portion 282 of the locking cup 224, or may be embodied as a separate component, similar to a Belleville washer. The bottom wall portion 282 extends radially from and connects the sleeve portion 227 to the cup portion 229.

The biasing element 272 may be a "wave washer," a Belleville washer, or a curved dome-shaped strip that is compressible and springy or resilient, for example. In one embodiment, the biasing element 272 includes a plurality of curved strips, portions or protrusions that form part of bottom wall portion 282. The biasing elements 272 extend upwardly from the bottom wall portion 282 and are positioned to engage the bottom of the locking portion 127 of the locking cap 126 when the locking cap is inserted into the locking cup 224 and fully secured by threaded engagement with each locking tab 141 engaged with a respective locking tooth 276. The compression of the biasing elements 272 urges the locking cap 126 upwardly and causes each locking tab 141 to be urged against a locking tooth 276.

One embodiment of a biasing element 272 is formed of the material of the bottom wall portion 282. The bottom wall portion 282 includes a disc-shaped central portion 284 and two or more connection portions 286 that extend between the central portion and the wall 231. Each biasing element 272 extends between adjacent sides of adjacent connection portions 286 and are shaped to extend upwardly from the plane of the bottom wall portion 282. The locking cup 224 bottom wall portion 282, central portion 284, connections portions 286 and resilient biasing elements 272 may be formed as a unitary, single-piece construction. Unlocking the locking cap 126 from the locking cup 224 requires that the cap be pressed inwardly toward the locking cup to compress the biasing elements 272, which in turn frees and spaces the locking tabs 141 from the locking teeth 276 and permits the locking teeth to clear the locking tabs. The disengagement of the tabs 141 from the teeth 276 permits the locking cap 126 to be turned counterclockwise and removed from within the locking cup 224 assuming a common "right hand" thread formation is employed.

FIG. 15 shows locking cap 126 engaged to the locking cup 224. The biasing elements 272 are not yet compressed. Advancing the locking cap 126 into the locking cup 224 further causes the biasing elements 272 to become compressed, which causes a bias of the locking cap 126 upwardly as oriented in the figure and causes the locking tabs 141 to engage with the locking teeth 276 such that the locking cap 126 resists being turned counterclockwise. Thus, the cap 126 is reversibly secured to the locking cup 224. In an alternative embodiment, each locking tab 141 may include a plurality of teeth, each of which can engage the locking tooth as previously described in a ratcheting fashion depending on the rotational position of the locking cap 126 in the locking cup 224.

Figure 16:
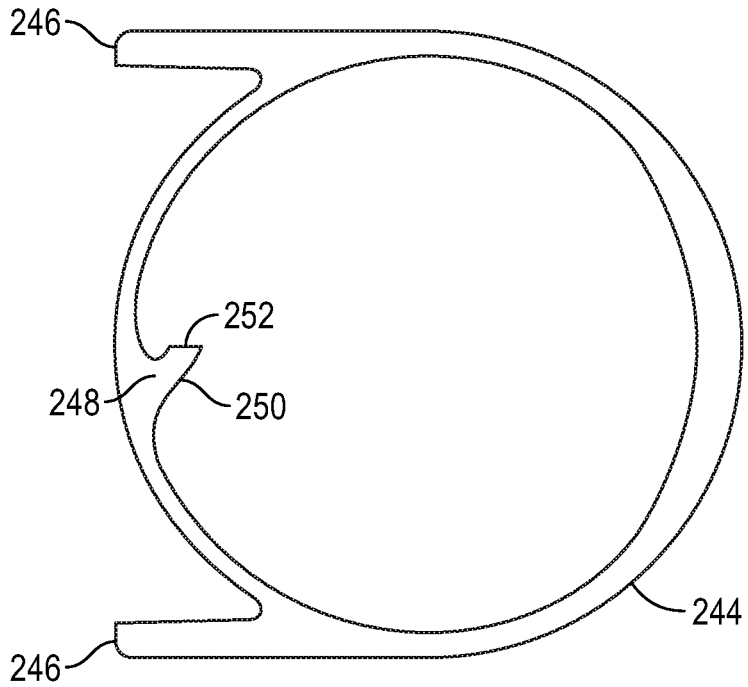
FIG. 16 is a perspective view of a second embodiment of an integrated pawl in accordance with the disclosure.

As best shown in FIG. 16, a second embodiment of the flexible collar 244 is shown that includes an inward-facing integral pawl 248. The pawl 248 is substantially wedge-shaped and modified from the above embodiment with an arcuate and slightly convex supporting portion 250 and a stopping portion 252. The flexible collar 244 itself is partially integral with the remainder of the ratchet sleeve 116 (see FIG. 6) and connects to the ratchet sleeve via a bridge 154 (see FIG. 6). In the illustrated embodiment, the pawl 248 is disposed in the same position as the pawl 148 of the embodiment of FIG. 6. When a user applies force to the tabs 246, for example, squeezing the tabs toward one another, the flexible collar 244 can flex from a substantially circular shape to an ovular shape that moves the pawl 248. In some embodiments, the flexible collar 244 is biased into a substantially circular shape such that it will spring back into a substantially circular shape when the force applied to the tabs 246 is released.

While the arrangement is illustrated in connection with a mop, the arrangement disclosed herein has universal applicability in various other types of cleaning implements as well. It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A mop, comprising:

a mop handle with a grip end and a mopping end;

a locking cup disposed on the mopping end of the mop handle, the locking cup including a cup portion including interior threads, a sleeve portion attached to the mopping end, and a bottom wall portion between the cup portion and the sleeve portion;

a mop head disposed at the mopping end of the mop handle, the mop head connected to a locking cap, the locking cap including a locking tab configured to selectively engage with the interior threads of the locking cup so as to allow for selective removal of the mop head from the mop handle; and a biasing element disposed in the cup portion and configured to contact the locking cap and generate a bias between the locking cap and the locking cup when the locking cap is threaded into the cup portion, the biasing element including a plurality of curved dome-shaped strips that are compressible and springy and form part of the bottom wall portion and extend upwardly from the bottom wall portion.

2. The mop of claim 1, wherein the biasing element is formed as a single-piece construction with the locking cup.

3. The mop of claim 1, wherein the biasing element is formed with the bottom wall portion.

4. The mop of claim 1, wherein the bottom wall portion includes a central portion and two or more connecting portions, the two or more connecting portions extending between the central portion and the cup portion.

5. The mop of claim 4, wherein the bottom wall portion extends radially from the sleeve portion and is disk-shaped.

6. The mop of claim 4, including at least two biasing elements, the at least two biasing elements extending between adjacent connection portions.

7. The mop of claim 6, wherein each of the at least two biasing elements are shaped and sized to extend upwardly from the bottom wall portion.

8. The mop of claim 1, further comprising a locking tooth disposed on the interior threads of the locking cup and shaped and sized to engage the locking tab of the locking cap.

9. The mop of claim 8, wherein the locking tooth includes a ramp side that is shaped and sized to deflect resiliently the locking tab from an initial radially extending position on the locking cap.

10. The mop of claim 9, wherein the locking tooth includes a retaining side that is sized and shaped to retain the locking tooth in position when the locking tooth is engaged therewith.

11. A mop comprising:

a mop handle with a grip end and a mopping end;

a locking cup disposed on the mopping end of the mop handle, the locking cup including a cup portion with interior threads, a sleeve portion attached to the mopping end, and a bottom wall portion between the cup portion and the sleeve portion, wherein the interior threads include a locking tooth formed thereon;

a mop head disposed at the mopping end of the mop handle, the mop head connected to a locking cap, the locking cap including a locking tab configured to selectively engage with the interior threads of the locking cup so as to allow for selective removal of the mop head from the mop handle and configured to engage and be retained by the locking tooth when the locking cap is threaded into the locking cup; and a biasing element disposed in the cup portion and configured to contact the locking cap and generate a bias between the locking cap and the locking cup and urge the locking tab against the locking tooth when the locking cap is threaded into the cup portion, wherein the biasing element includes a plurality of curved dome-shaped strips that are compressible and springy and form part of the bottom wall portion and extend upwardly from the bottom wall portion.

12. The mop of claim 11, including at least two locking tabs formed on the locking cap and at least two corresponding locking teeth formed on the interior threads.

* * * * *